US005947113A

United States Patent [19]

Beal et al.

[11] Patent Number: 5,947,113

[45] Date of Patent: Sep. 7, 1999

[54] DIRECT VENT GAS APPLIANCE WITH VERTICAL AND HORIZONTAL VENTING

[75] Inventors: Thomas J. Beal, Ossian; Albert K. Teakell; Robert E. Cabrera, both of Fort Wayne, all of Ind.; Michael E. Marusak, Wheaton, Ill.

[73] Assignee: The Majestic Products Company, Mississauga, Canada

[21] Appl. No.: 09/028,695

[22] Filed: Feb. 24, 1998

Related U.S. Application Data

[63] Continuation of application No. 08/462,915, Jun. 5, 1995, abandoned, which is a continuation of application No. 08/339,921, Nov. 15, 1994, abandoned, which is a continuation of application No. 08/172,840, Dec. 23, 1993, abandoned, which is a continuation of application No. 08/018,051, Feb. 16, 1993, Pat. No. 5,320,086.

[51] Int. Cl.[6] ..... F23C 3/00

[52] U.S. Cl. ..... 126/512; 126/515; 126/85 B

[58] Field of Search ..... 126/512, 515–518, 126/85 B

[56] References Cited

U.S. PATENT DOCUMENTS

| | | |
|---|---|---|
| 2,582,066 | 1/1952 | Resek . |
| 2,998,764 | 9/1961 | Bedell et al. . |
| 3,168,088 | 2/1965 | Martin et al. . |
| 3,171,140 | 3/1965 | Carlson . |
| 3,395,693 | 8/1968 | Cowan . |
| 3,435,816 | 4/1969 | DeWerth . |
| 3,614,948 | 10/1971 | Jackson et al. . |
| 3,741,194 | 6/1973 | Herron . |
| 4,112,913 | 9/1978 | Shimek . |
| 4,141,336 | 2/1979 | Fitch . |
| 4,184,473 | 1/1980 | McIntire et al. . |
| 4,204,517 | 5/1980 | Rumsey . |
| 4,224,921 | 9/1980 | Petrescue . |
| 4,271,815 | 6/1981 | Johnson . |
| 4,304,215 | 12/1981 | Jarman . |
| 4,347,831 | 9/1982 | Graziano . |
| 4,349,009 | 9/1982 | Patterson et al. . |
| 4,359,040 | 11/1982 | Martenson . |
| 4,377,153 | 3/1983 | Flagg . |
| 4,408,594 | 10/1983 | Shimek . |
| 4,412,525 | 11/1983 | Aidla . |
| 4,424,792 | 1/1984 | Shimek et al. . |
| 4,434,783 | 3/1984 | O'Gorman . |
| 4,465,055 | 8/1984 | Bortz . |
| 4,471,755 | 9/1984 | Faehling et al. . |
| 4,494,525 | 1/1985 | Albertsen . |
| 4,519,376 | 5/1985 | Schoeff et al. . |

(List continued on next page.)

*Primary Examiner*—Carroll B. Dority
*Attorney, Agent, or Firm*—Baker & Daniels

[57] ABSTRACT

The invention relates to a direct vent gas fireplace adapted for attachment to a concentric flue pipe assembly having an exhaust pipe and fresh air pipe. A top wall, rear wall, bottom wall and side walls define a combustion chamber. A gas burner is disposed in the combustion chamber. A slanted flue attachment wall is attached to and extends between the top wall and rear wall. The slanted flue attachment wall is disposed at obtuse angles relative to the top wall and rear wall. A first pipe member is orthogonally attached to the flue attachment wall and is in fluid communication with the combustion chamber for conveying combustion products from the combustion chamber. A second pipe member having a diameter larger than the first pipe member is disposed concentrically around the first pipe member. The first and second pipe members define an annular space therebetween forming an air intake duct. A combustion air duct extends between and is in fluid communication with the air intake duct and the combustion chamber for supplying combustion air to the combustion chamber. The exhaust pipe and fresh air pipe are respectively attached to the first and second pipe members and can be selectively oriented to extend away from the fireplace in a substantially vertical or horizontal direction.

16 Claims, 3 Drawing Sheets

U.S. PATENT DOCUMENTS 4,545,360 10/1985 Smith et al. .
4,558,688 12/1985 Piazzetta .
4,574,773 3/1986 Moughamian .
4,611,572 9/1986 Martenson .
4,787,365 11/1988 Coleman .
4,793,322 12/1988 Shimek et al. .
4,875,464 10/1989 Shimek .
4,886,047 12/1989 Bonin .
4,909,227 3/1990 Rieger .
4,952,548 8/1990 Shimek .
5,000,162 3/1991 Shimek .
5,014,684 5/1991 Meeker .
5,016,609 5/1991 Shimek et al. .
5,076,254 12/1991 Shimek et al. .
5,191,877 3/1993 Shimek .
5,218,953 6/1993 Shimek .
5,267,552 12/1993 Squires et al. ..... 126/512
5,320,086 6/1994 Beal et al. ..... 126/512

DIRECT VENT GAS APPLIANCE WITH VERTICAL AND HORIZONTAL VENTING

This application is a continuation of application Ser. No. 08/462,915 filed Jun. 5, 1995 and now abandoned, which is a continuation of application Ser. No. 08/339,921 filed Nov. 15, 1994 and now abandoned, which is a continuation of application Ser. No. 08/172,840 filed Dec. 23, 1993 and now abandoned, which is a continuation of application Ser. No. 08/018,051, filed Feb. 16, 1993 and now U.S. Pat. No. 5,320,086.

BACKGROUND OF THE INVENTION

1. Field of the Invention

The present invention relates to fireplaces and, in particular, to direct vent gas fireplaces.

2. Description of the Related Art

Gas fireplaces of conventional design typically utilize a source of combustion air from the room being heated. This lowers the efficiency of the gas fireplace because a portion of the heated air in the room is drawn into the combustion chamber and exhausted up the chimney. It is known to provide separate ducting from the outside ambient environment to the combustion chamber to increase the efficiency of the fireplace. The ducted air provides a source of oxygen for combustion in the combustion chamber and decreases the amount of air from the room being heated which is exhausted up the chimney. Such ducting, however, requires additional materials and labor to install.

It is also known in the art to utilize concentric flue pipes to exhaust combustion products to the outside environment and supply combustion air from the outside environment. Such fireplaces are termed "direct vent" fireplaces and are disclosed, e.g., in U.S. Pat. Nos. 4,793,322 (Shimek et al.) and 4,909,227 (Rieger). A direct vent fireplace has the advantage of utilizing a common concentric flue pipe assembly to both exhaust combustion products from and supply combustion air to the combustion chamber. Moreover, only a single opening need be cut through an exterior wall of a house to accommodate the concentric flue pipe assembly.

In general, a direct vent fireplace has a first pipe with a diameter larger than and disposed concentrically around a second pipe. The duct formed by the second pipe is used to convey exhaust products from the combustion chamber to the outside environment. The annular space formed between the first and second pipes defines a fresh air conduit through which combustion air flows from the outside ambient environment into the combustion chamber.

A problem with direct vent gas fireplaces is that the concentric flue pipe assembly cannot be easily vented in both a horizontal or vertical direction. Shimek et al. and Rieger disclose direct vent fireplaces which respectively connect the concentric flue to the back wall and top wall of the fireplace. A concentric flue attached to the back wall of the fireplace may be easily extended through an adjacent side wall of the house. However, if it is desirable to exhaust the concentric flue in a vertical direction, the fireplace must be moved forward a sufficient distance to allow coupling of a right angle concentric pipe elbow. Thus, additional floor space is required to accommodate the projected footprint of the fireplace and concentric flue pipe assembly.

A concentric flue pipe assembly attached to the top of a direct vent fireplace has a similar problem when it is desired to vent the concentric flue in a horizontal direction (see, e.g., Rieger at Col. 1, lines 23–32). That is, the fireplace must be moved forward a sufficient distance to allow coupling of a right angle concentric pipe elbow.

Because of two possible installation configurations, i.e., vertical or horizontal venting of the concentric flue pipe assembly, it is necessary with conventional direct vent fireplace designs to provide two totally different configurations. That is, for relatively close placement of the fireplace adjacent the outside wall of the house, it is necessary to provide one configuration allowing attachment of the concentric flue pipe assembly to the back of the fireplace for horizontal venting, and a second configuration allowing attachment of the concentric flue pipe assembly to the top of the fireplace for vertical venting. The necessity to provide two different configurations increases inventory requirements at the factory. An installer must order either a vertical or horizontal venting fireplace prior to installation. What is needed, therefore, is a direct vent fireplace which reduces the required inventory which must be kept on hand.

Moreover, an installer may not know whether a vertical or horizontal venting fireplace is needed prior to installation. Therefore, what is needed in the art is a direct vent gas fireplace allowing a concentric flue to be selectively vented in either a horizontal or vertical direction.

SUMMARY OF THE INVENTION

The present invention provides a direct vent gas fireplace allowing a concentric flue to be selectively vented in either a vertical or horizontal direction.

The invention comprises, in one form thereof, a direct vent gas fireplace adapted for attachment to a concentric flue pipe assembly having an exhaust pipe and fresh air pipe. A top wall, rear wall, bottom wall and side walls define a combustion chamber. A gas burner is disposed in the combustion chamber. A slanted flue attachment wall is attached to and extends between the top wall and rear wall. The slanted flue attachment wall is disposed at obtuse angles relative to the top wall and rear wall. A first pipe member is orthogonally attached to the flue attachment wall and is in fluid communication with the combustion chamber for conveying combustion products from the combustion chamber. A second pipe member having a diameter larger than the first pipe member is disposed concentrically around the first pipe member. The first and second pipe members define an annular space therebetween forming an air intake duct. A combustion air duct extends between and is in fluid communication with the air intake duct and the combustion chamber for supplying combustion air to the combustion chamber. The exhaust pipe and fresh air pipe are respectively attached to the first and second pipe members and can be selectively oriented to extend away from the fireplace in a substantially vertical or horizontal direction.

An advantage of the present invention is that the concentric flue may be easily vented in either a horizontal or vertical direction.

A further advantage is that the concentric flue may be selectively vented in either a horizontal or vertical direction utilizing the same fireplace components.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
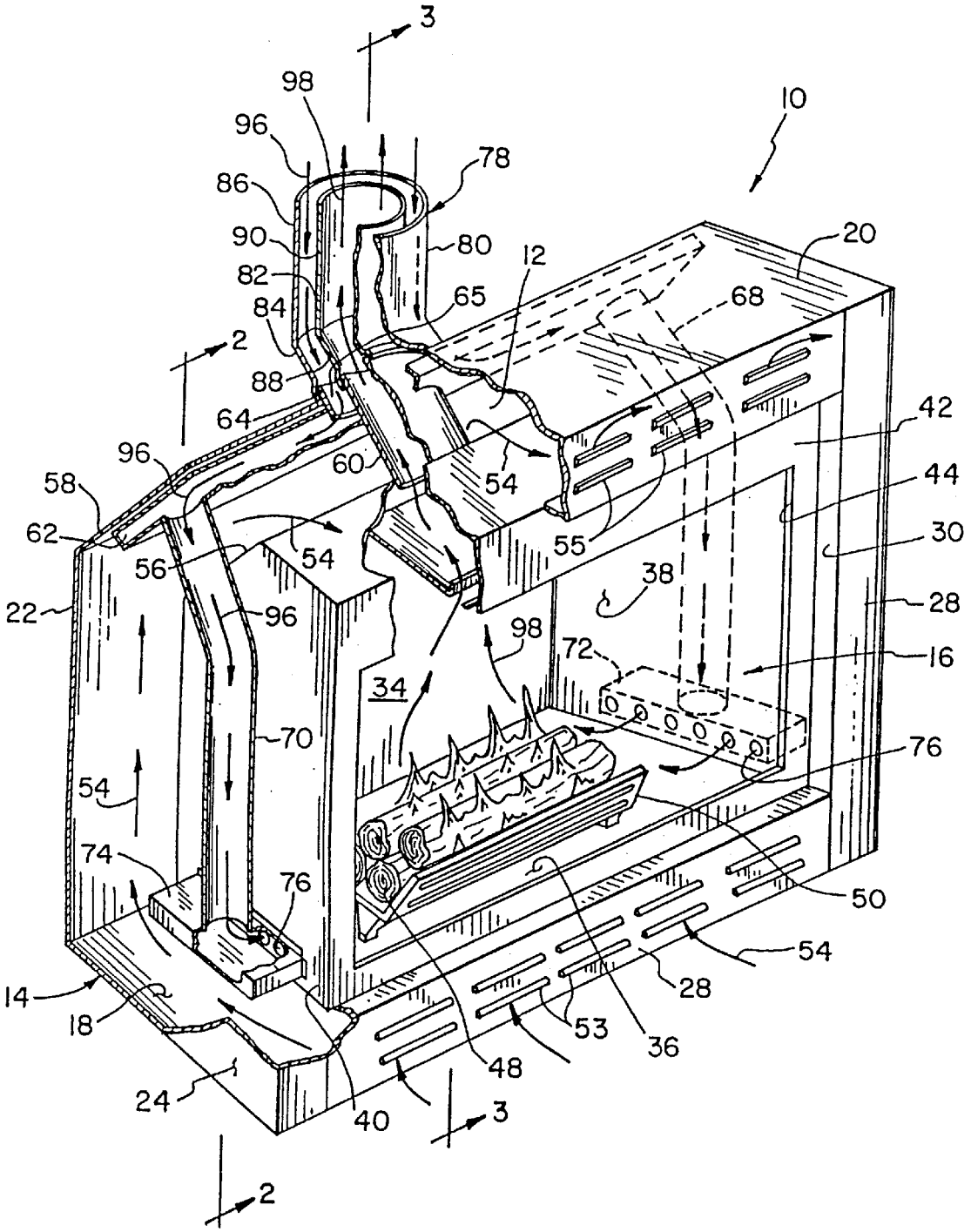
FIG. 1 is a fragmentary perspective view of the direct vent gas fireplace according to one embodiment of the present invention.
Figure 2:
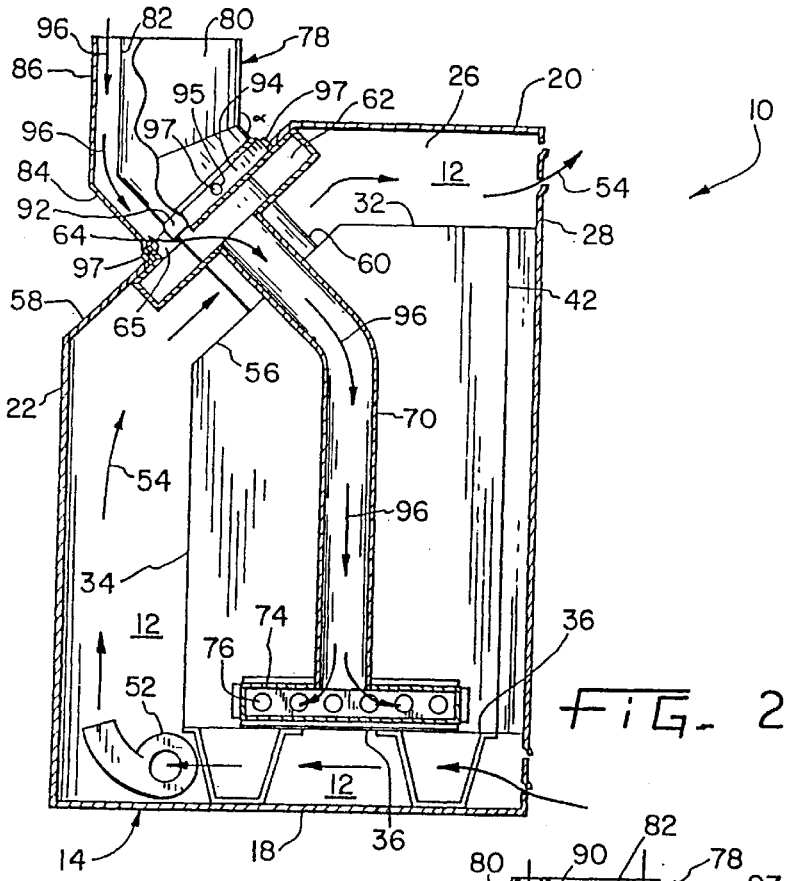
FIG. 2 is a fragmentary sectional view taken along line 2—2 of FIG. 1.
Figure 3:
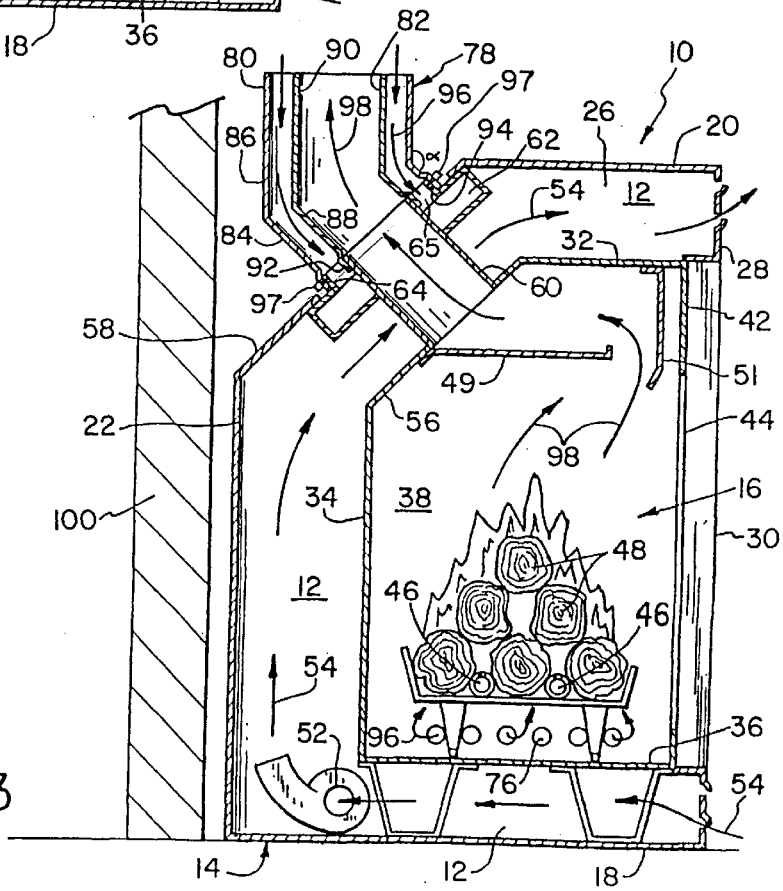
FIG. 3 is a sectional view taken along line 3—3 of FIG. 1 illustrating vertical venting of the gas appliance.

Referring now to the drawings and particularly to FIGS. 1–3, there is shown a direct vent gas fireplace 10 having room air circulation channel 12 disposed between an exterior housing 14 and combustion chamber 16. Exterior housing 14 includes an exterior bottom wall 18, exterior top wall 20, exterior back wall 22, exterior side walls 24 and 26, and a front wall 28 defining an opening 30. In the embodiment shown, exterior top wall 20 defines a horizontal plane.

Figure 4:
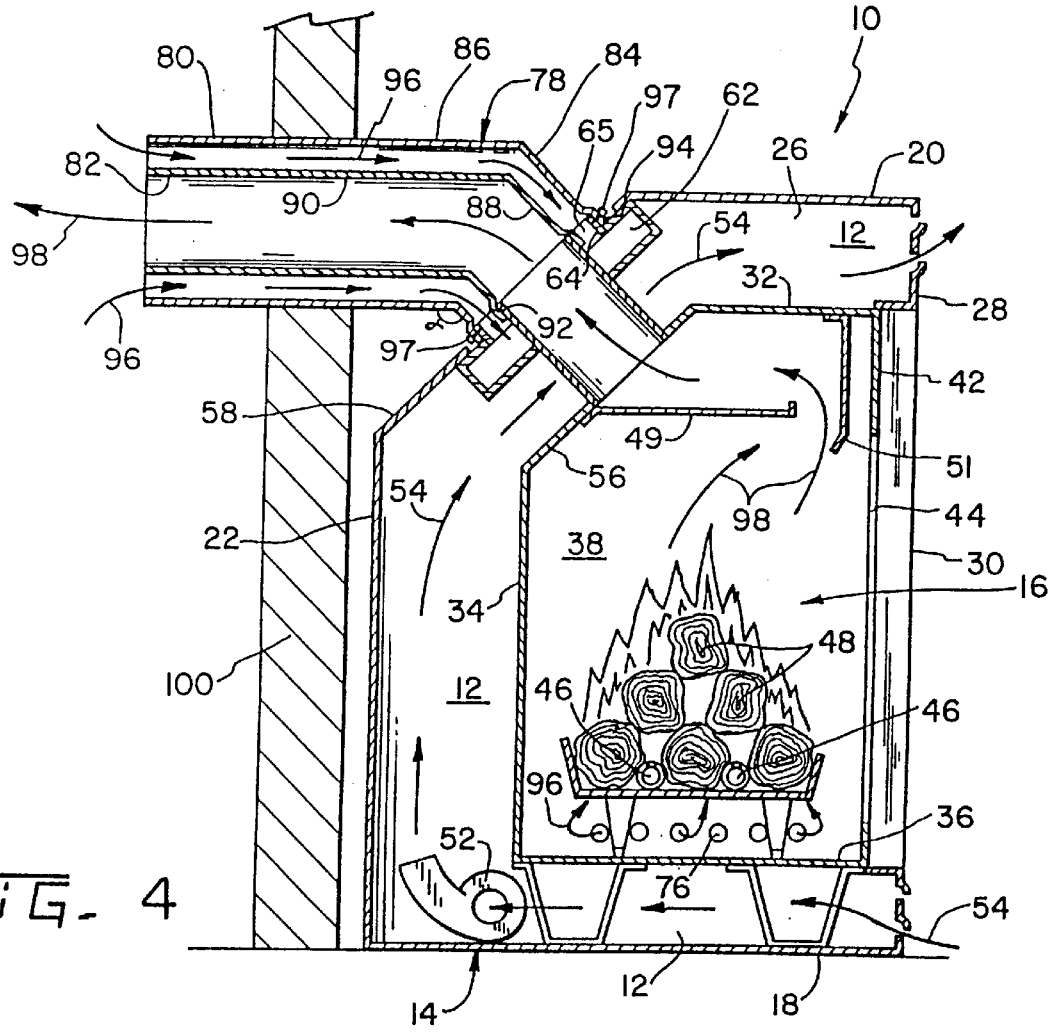
FIG. 4 is a sectional view similar to FIG. 3 illustrating horizontal venting of the gas appliance.

Combustion chamber 16 includes a top wall 32, rear wall 34, bottom wall 36, two sidewalls 38 and 40, and front wall 42 defining an opening 44. As in all direct vent fireplaces, it is necessary that a glass panel (not shown) sealably covers the combustion chamber opening. Disposed within combustion chamber 16 is a gas burner 46 disposed below a plurality of decorative logs 48. Decorative logs 48 are supported by a grate 50 and are viewed through the glass panel. As best seen in FIG. 4, disposed in the upper portion of combustion chamber 16 are horizontal baffle plate 49 and vertical baffle plate 51 for directing the flow of combustion products from combustion chamber 16 to the inlet of an exhaust pipe member which directly opens into the combustion chamber above horizontal baffle plate 49.

Disposed within room air circulation channel 12 is a blower 52 for circulating air. Ambient air from the living space in which direct vent gas fireplace 10 is located is drawn into room air circulation channel 12 at the bottom of direct vent gas fireplace 10 through openings 53 and is exhausted back into the ambient environment at the top of direct vent gas fireplace 10 through openings 55, as shown by air flow directional arrows 54. The ambient air drawn into room air circulation channel 12 is heated via convection heat transfer as it flows past bottom wall 36, rear wall 34 and top wall 32 and is exhausted back into the ambient environment at a higher temperature.

In accordance with the present invention, a slanted flue attachment wall 56 is attached to and extends between top wall 32 and rear wall 34 and forms obtuse angles with top wall 32 and rear wall 34. In the embodiment shown, slanted flue attachment wall 56 is disposed at obtuse angles of about 135° with respect to each of top wall 32 and rear wall 34. That is, slanted flue attachment wall 56 is disposed at an angle of about 45° with respect to a horizontal plane, which in the embodiment shown is defined by exterior top wall 20.

Disposed generally parallel to slanted flue attachment wall 56 is a slanted exterior flue attachment wall 58 attached to exterior top wall 20 and exterior back wall 22, and disposed at an angle of about 450 with respect to the horizontal plane defined by exterior top wall 20.

Attached to slanted flue attachment wall 56 and extending orthogonally therefrom is a first pipe member 60 which acts as an exhaust conduit and is in fluid communication with the combustion chamber for conveying combustion products from the combustion chamber. First pipe member 60 extends through slanted exterior wall 58, its inlet directly opening into combustion chamber 16 above horizontal baffle 49, which is attached to wall 56 directly below the first pipe member inlet.

Disposed adjacent to slanted exterior wall 58 is a plenum 62. A second pipe member 64, which forms a boundary of the combustion air inlet is attached to and in fluid communication with plenum 62. Second pipe member 64 extends through slanted exterior wall 58 of exterior housing 14. Second pipe member 64 has a diameter larger than and is disposed concentrically around first pipe member 60. The annular space formed between first pipe member 60 and second pipe member 64 defines an air intake duct 65 through which combustion air flows into plenum 62.

A pair of air distribution conduits 68 and 70 are attached to plenum 62 at one end thereof, and respectively attached to a pair of second plenums 72 and 74 at the other ends thereof. Air distribution conduits 68 and 70 are respectively disposed adjacent to sidewalls 38 and 40 of combustion chamber 16. First and second plenums 72 and 74 include a plurality of openings 76 through which combustion air is drawn into combustion chamber 16. Plenum 62, air distribution conduits 68 and 70, and second plenums 72 and 74 define a combustion air duct (not numbered) for supplying combustion air to combustion chamber 16.

A concentric flue pipe assembly 78 includes a fresh air pipe 80 and exhaust pipe 82. Fresh air pipe 80 and exhaust pipe 82 both include first and second tubular portions 84 and 86, and 88 and 90 respectively. First and second tubular portions 84 and 86 of fresh air pipe 80 have a diameter larger than and are concentrically disposed around first and second tubular portions 88 and 90 of exhaust pipe 82. Moreover, first and second tubular portions 84 and 86, and first and second tubular portions 88 and 90 are disposed relative to each other at an angle of about 135° therebetween, indicated by the symbol $\alpha$ in FIGS. 2–4.

First tubular portions 88 and 84 of concentric flue pipe assembly 78 include mating flange portions 92 and 94 which respectively attach to first and second pipe members 60 and 64. Holes 95 formed in mating flange portion 94 align with holes formed in second pipe member 64. Fastening devices, such as screws 97, are threadingly engaged in holes 95 to fasten concentric flue pipe assembly 78 in place.

During operation, air flow through direct vent gas fireplace 10 is as follows: combustion air flows through the annular space defined between fresh air pipe 80 and exhaust pipe 82 from the ambient environment outside the house in which direct vent gas fireplace 10 is installed. The combustion air flows through air intake duct 65 and combustion air duct 66 (including plenum 62, air distribution conduits 68 and 70, and second plenums 72 and 74) into combustion chamber 16. The flow of combustion air into combustion chamber 16 is represented by air flow directional arrows 96 in FIGS. 1–4. The combustion air, drawn through openings 76, assists combustion within combustion chamber 16. Combustion products produced in combustion chamber 16 flow through the opening defined between baffle plates 49 and 51, first pipe member 60, and are exhausted to the outside environment through exhaust pipe 82. The flow of combustion products from combustion chamber 16 is represented in FIGS. 1, 3 and 4 by directional arrows 98. As clearly shown in these figures, combustion products exiting combustion chamber 16 flow between baffles 49 and 51 and immediately enter exhaust pipe 88 through first pipe member 60.

FIG. 4 illustrates attachment of concentric flue pipe assembly 78 to direct vent gas fireplace 10 whereby concentric flue pipe assembly 78 extends away from gas fireplace 10 in a generally horizontal direction. To select horizontal venting, concentric flue pipe assembly 78 is rotated 180° from the position shown in FIGS. 1–3 prior to engagement of first tubular portions 88 and 84 with first and second pipe members 60 and 64. Holes 95 are located in mating flange portion 94 and second pipe member 64 such that screws 97 may be inserted in holes 95 and engage the aligned holes formed in second pipe member 64 regardless of whether concentric flue pipe assembly 78 is vented vertically (FIGS. 1–3) or horizontally (FIG. 4). When horizontal venting is selected, air flow through concentric flue pipe assembly 78 and direct vent gas fireplace 10 is the same as disclosed above. Thus, the embodiment of the present invention shown in the drawings allows selective venting of gas fireplace 10 whereby concentric flue pipe assembly 78 extends away from gas fireplace 10 in a substantially horizontal or vertical direction.

Thus, the embodiment of the present invention shown in the drawings allows second tubular portion 86 and 90 of eccentric flue pipe 78 to be selectively vented in either a vertical or horizontal direction. As shown in FIG. 3 (vertical venting) and FIG. 4 (horizontal venting), direct vent gas fireplace 10 may be disposed closely adjacent to an exterior wall 100 regardless of whether vertical or horizontal venting of concentric flue pipe assembly 78 is selected.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A direct vent gas fireplace adapted for attachment to a concentric flue pipe assembly including attached first and second portions disposed at an obtuse angle relative to each other, each portion having an exhaust pipe and a fresh air pipe concentric therewith, said fireplace comprising:

a top wall, rear wall, bottom wall, side walls and a slanted flue attachment wall defining a combustion chamber, said slanted flue attachment wall attached to and extending between said top and rear walls, said slanted flue attachment wall disposed at an obtuse angle relative to said top and rear walls;

said combustion chamber provided with a baffle plate extending between said combustion chamber side walls and abutting one of said combustion chamber rear wall and said slanted flue attachment wall;

a gas burner disposed in said combustion chamber;

an exhaust conduit orthogonally connected to said flue attachment wall and in fluid communication with said combustion chamber through said flue attachment wall and above said baffle plate, said exhaust conduit attached to the exhaust pipe of the first flue pipe assembly portion, whereby combustion products are conveyed from said combustion chamber to the flue pipe assembly;

a combustion air pipe member disposed concentrically around said exhaust conduit, said combustion air pipe member attached to the fresh air pipe of the first flue pipe assembly portion, said exhaust conduit and said combustion pipe member defining an annular air intake duct therebetween; and a combustion air duct extending between and in fluid communication with said air intake duct and said combustion chamber for supplying combustion air to said combustion chamber;

the flue pipe assembly selectively having one of a first position wherein the second flue pipe assembly portion is substantially horizontal and a second position wherein the second flue pipe assembly portion is substantially vertical.

2. The fireplace of claim 1, wherein said combustion air duct comprises an air collector plenum attached to said combustion air pipe member and at least one air distribution conduit extending between said air collector plenum and said combustion chamber.

3. The fireplace of claim 2, wherein said combustion air duct further comprises at least one second plenum, each said second plenum respectively attached to and disposed between each said air distribution conduit and said combustion chamber, each said second plenum in fluid communication with said combustion chamber.

4. A direct vent gas fireplace comprising:

a combustion chamber having a top wall, a rear wall, a bottom wall, side walls, and a slanted flue attachment wall, said slanted flue attachment wall attached to and extending between said top and rear combustion chamber walls, said slanted flue attachment wall disposed at an obtuse angle relative to each of said top and rear combustion chamber walls, said combustion chamber provided with a baffle plate extending between said combustion chamber side walls and abutting one of said combustion chamber rear wall and said slanted flue attachment wall;

a gas burner disposed in said combustion chamber;

an exterior housing disposed in spaced apart relationship from said combustion chamber, said exterior housing having an exterior bottom wall, an exterior top wall, an exterior rear wall, exterior side walls, an exterior front wall defining an opening, and a slanted exterior wall, said slanted exterior wall attached to and extending between said top and rear exterior walls, said slanted exterior wall disposed at an obtuse angle relative to each of said top rear exterior walls;

a room air passage defined by the space between said combustion chamber and said exterior housing, wherein room air is heated;

an exhaust conduit orthogonally connected to said slanted flue attachment wall and in fluid communication with said combustion chamber through said flue attachment wall and above said baffle plate, said exhaust conduit extending through said slanted exterior wall, whereby combustion products are conveyed from said combustion chamber to the exterior of said exterior housing;

a combustion air pipe member disposed concentrically around said exhaust conduit and extending orthogonally from said slanted exterior wall, said exhaust conduit and said combustion air pipe member defining an annular air intake duct therebetween;

a combustion air duct extending between and in fluid communication with said air intake duct and said combustion chamber; and a concentric flue pipe assembly including attached first and second portions disposed at an obtuse angle relative to each other, each portion having an exhaust pipe and a fresh air pipe concentric therewith, said exhaust pipe of said first portion attached to said exhaust conduit, said fresh air pipe of said first portion attached to said combustion air pipe, said flue pipe assembly selectively having one of a first position wherein said second portion is substantially horizontal and a second position wherein said second portion is substantially vertical.

5. The fireplace of claim 4, wherein said combustion air duct comprises an air collector plenum attached to said combustion air pipe member and at least one air distribution conduit extending between said air collector plenum and said combustion chamber, said air collector plenum and air distribution conduit disposed within said room air passage.

6. The fireplace of claim 4, wherein said combustion air duct comprises an air collector plenum attached to said combustion air pipe member and at least one air distribution conduit extending between said air collector plenum and said combustion chamber, said air distribution conduit connected to the bottom of one of said sidewalls of said combustion chamber.

7. The fireplace of claim 5, further comprising an intermediate wall disposed between said slanted flue attachment wall and said slanted exterior wall, said slanted exterior wall and said intermediate wall forming said air collector plenum.

8. The fireplace of claim 4, further comprising a blower disposed within said room air passage, said blower receiving ambient air and circulating the air through said room air passage.

9. The fireplace of claim 4 wherein each said fresh air pipe and said exhaust pipe of said flue pipe assembly each comprise a first and second tubular portions bent at an angle relative to each other, said first tubular portions comprising said first flue pipe assembly portion, said second tubular portions comprising said second flue pipe assembly portion.

10. The fireplace of claim 9 wherein each said obtuse angle is about 135 degrees.

11. The fireplace of claim 9 further comprising a blower disposed within said room air passage, said blower receiving ambient air and circulating the air through said room air passage.

12. The fireplace of claim 6, further comprising an intermediate wall disposed between said slanted flue attachment wall and said slanted exterior wall, said slanted exterior wall and said intermediate wall forming said air collector plenum.

13. The fireplace of claim 1, wherein said baffle plate is substantially horizontal.

14. The fireplace of claim 1, wherein said baffle plate is a first baffle plate and said combustion chamber is provided with a second, substantially vertical baffle plate extending between said combustion chamber side walls, said second baffle plate depending from said top combustion chamber wall and located forward of said first baffle plate.

15. The fireplace of claim 4, wherein said baffle plate is substantially horizontal.

16. The fireplace of claim 4, wherein said baffle plate is a first baffle plate and said combustion chamber is provided with a second, substantially vertical baffle plate extending between said combustion chamber side walls, said second baffle plate depending from said top combustion chamber wall and located forward of said first baffle plate.

* * * * *